US005384628A

United States Patent [19]

Takami et al.

[11] Patent Number: 5,384,628

[45] Date of Patent: Jan. 24, 1995

[54] DEVELOPING DEVICE FOR IMAGE FORMING EQUIPMENT

[75] Inventors: Nobuo Takami, Tokyo; Kazuyuki Sugihara, Fujisawa; Takayuki Maruta, Tokyo; Kazuo Nojima, Chiba; Noboru Sawayama, Tokyo; Kaoru Yoshimatsu, Kawasaki; Katsuji Watabe, Fujimi; Takuji Yoneda, Yokohama, all of Japan

[73] Assignee: Ricoh Company, Ltd., Tokyo, Japan

[21] Appl. No.: 131,967

[22] Filed: Oct. 8, 1993

[30] Foreign Application Priority Data

| | | | |
|---|---|---|---|
| Oct. 10, 1992 | [JP] | Japan | 4-298114 |
| Nov. 7, 1992 | [JP] | Japan | 4-322512 |
| Jan. 11, 1993 | [JP] | Japan | 5-002705 |
| Jan. 11, 1993 | [JP] | Japan | 5-002706 |
| Jan. 21, 1993 | [JP] | Japan | 5-008368 |

[51] Int. Cl.[6] ..... G03G 15/06

[52] U.S. Cl. ..... 355/259; 118/653; 355/245

[58] Field of Search ..... 355/245, 251, 253, 259, 355/260, 200, 210; 118/656–658, 653, 661; 222/DIG. 1

[56] References Cited

U.S. PATENT DOCUMENTS

| | | | |
|---|---|---|---|
| 4,044,719 | 8/1977 | Ohmori | 118/658 X |
| 4,989,037 | 1/1991 | Nagatsuna | 355/200 |

FOREIGN PATENT DOCUMENTS

| | | | |
|---|---|---|---|
| 0065278 | 4/1986 | Japan | 355/251 |
| 0000583 | 1/1989 | Japan | 355/251 |
| 0105976 | 4/1989 | Japan | 355/251 |
| 0108569 | 4/1989 | Japan | 355/251 |
| 0137277 | 5/1989 | Japan | 355/251 |
| 0159677 | 6/1989 | Japan | 355/251 |
| 0205875 | 8/1990 | Japan | 355/251 |
| 0220084 | 9/1990 | Japan | 355/251 |
| 0165340 | 7/1993 | Japan | 355/251 |

*Primary Examiner*—Matthew S. Smith

*Attorney, Agent, or Firm*—Oblon, Spivak, McClelland, Maier & Neustadt

[57] ABSTRACT

A developing device for image forming equipment capable of agitating and mixing a fresh toner and a developer sufficiently is disclosed. The device eliminates a change in image density among individual copies, irregularity in density corresponding to the spiral pitch of, for example, a toner transport screw, and irregularity in density in the front-and-rear direction (axial direction of a developing sleeve) ascribable to defective agitation. To replace or clean a desire part or parts built in a developing device, the device is divided into two such that the desired parts are freely accessible. This facilitates the cleaning and replacement of such parts.

33 Claims, 13 Drawing Sheets

DEVELOPING DEVICE FOR IMAGE FORMING EQUIPMENT

BACKGROUND OF THE INVENTION

The present invention relates to a developing device applicable to an electrophotographic copier, facsimile machine, printer or similar image forming equipment and, more particularly, to a vertical developing device advantageously applicable to a color copier.

A vertical developing device for the above application usually has a housing formed with an opening which faces an image carrier in the form of a photoconductive element. A developing sleeve is disposed in the housing and provided with a magnet therein. The sleeve is partly exposed to the outside via the opening of the housing. A sponge roller supplies a toner to a toner supply roller which, in turn, supplies it to the developing sleeve. An agitator agitate a fresh toner fed from a toner tank by a screw. A blade is held in contact with the toner supply roller to form a thin toner layer thereon. A trough-like screw casing is formed with a developer inlet and a developer outlet. An upper transport screw is surrounded by the screw casing and rotated in a predetermined direction for conveying the developer to the developer outlet. A lower transport screw is located above the developing sleeve for conveying the developer in a predetermined direction. A doctor is held in contact with the developing sleeve and forms a part of the housing. The housing is divided into a developer agitating chamber accommodating the sleeve, screws and doctor, and a toner storing chamber accommodating the agitator, blade, and rollers.

The developing device having the above construction allows the toner supply roller to supply a sufficiently charged fresh toner to the developer deposited on the developing sleeve. Hence, the interval between the time when the toner is supplied and the time when it is actually used for development is short, enhancing rapid response in toner supply control. In addition, since the frictional charging of the toner scarcely relies on the developer, the total amount of developer required to exist in the device can be reduced.

However, the conventional developing device has some problems left unsolved, as follows. Since the developer is not scraped off from the developing sleeve over the entire longitudinal area, the developer is continuously circulated due to the rotation of the sleeve. In this condition, the developer deteriorates rapidly, degrading the image quality. Moreover, the developer being continuously circulated due to the rotation of the sleeve cannot be fully agitated or mixed with the fresh toner fed from the toner supply roller. This brings about a change in density among individual copies, irregularity in density corresponding to the spiral pitch of each of the upper and lower screws, irregularity in density in the front-and-rear direction (axial direction of the sleeve) ascribable to defective lateral agitation, etc. Such changes and irregularities in density critically lower the image density in the event of, among others, full color development.

Further, in the conventional device, the agitation and mixture of the developer relies on the transporting force of the developing sleeve. Therefore, a decrease in the linear velocity of the sleeve translates into the short agitation of the developer. For this reason, the linear velocity of the sleeve cannot be made as low as the linear velocity of the image carrier.

The blade is held in contact with the toner supply roller to form a thin toner layer thereon, as stated earlier. The toner regulating ability of this roller decreases due to aging, i.e., changes in the surface roughness and other surface properties thereof ascribable to wear, toner filming, deterioration of rubber or similar surface material, etc.. Hence, the toner supply roller has to be cleaned or replaced from time to time. The blade also needs cleaning or replacement since the toner adheres thereto due to aging and lowers the toner regulating ability. So long as such members needing cleaning or replacement are positioned in the vicinity of the opening of the housing which faces the image carrier, they can be cleaned or replaced relatively easily. However, when such members are remote from the opening of the housing, they cannot be cleaned or replaced easily. Moreover, since these members form part of a partition delimiting the toner storing chamber, it is likely that the toner in the toner storing chamber is mixed with a two-component developer, i.e., a mixture of toner carrier existing in the developing and agitating chamber in the event of cleaning or replacement.

SUMMARY OF THE INVENTION

It is, therefore, an object of the present invention to provide a developing device for image forming equipment which enhances the durability of a developer, and the mixture of a fresh toner and a developer.

It is another object of the present invention to provide a developing device for image forming equipment which facilitates the cleaning and replacement of various parts built in the device.

In accordance with the present invention, a developing device for supplying a developer made up of a toner and a carrier to an image carrier for thereby developing a latent image electrostatically formed on the image carrier comprises a developer carrier for supplying the developer deposited thereon to the image carrier, a toner supplying member for supplying a fresh toner to the developer deposited on the developer carrier in contact with the developer, a transporting member for scooping up the developer from the developer carrier and transporting it upward, and an agitating member for agitating the developer scooped up by the transporting member.

Also, in accordance with the present invention, a process unit for image formation comprises a rotatable body needing cleaning or replacement, and a first and a second physically independent side wall pair overlapping each other at opposite sides with respect to an axial direction of the rotatable body. The first and second side wall pairs are each provided with a hole for a bearing at each of opposite overlapping portions. The rotatable body includes opposite shaft portions held by the first side wall pair via first bearings which are removably mounted on the shaft portions and received in the holes of the first side wall pair. The shaft portions are further held by the second side wall pair via second bearings which are removably mounted on the shaft portions and received in the holes of the second side wall pair.

Further, in accordance with the present invention, a process unit for image formation comprises a rotatable body needing cleaning or replacement, and a contact member contacting the periphery of the rotatable body in the axial direction of the rotatable body. The rotatable body, contact member and a side wall form a part of walls which define a developer storing section. A first side wall pair constitutes opposite side walls of the developer storing section. A second side wall pair constitutes opposite side walls of the unit other than the developer storing section. The first and second side wall pairs are divided at a position close to opposite sides of the rotatable body with respect to the axial direction of the rotatable body. The rotatable body and contact member are held by the first side wall pair.

Moreover, in accordance with the present invention, a process unit for image formation comprises a flat member needing cleaning or replacement and constituting a part of walls of a developer storing section in combination with a side wall, a first side wall pair constituting opposite side walls of the developer storing section, a second side wall pair constituting opposite side walls of the unit other than the developer storing section. The flat member is removably held by the first side wall pair.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
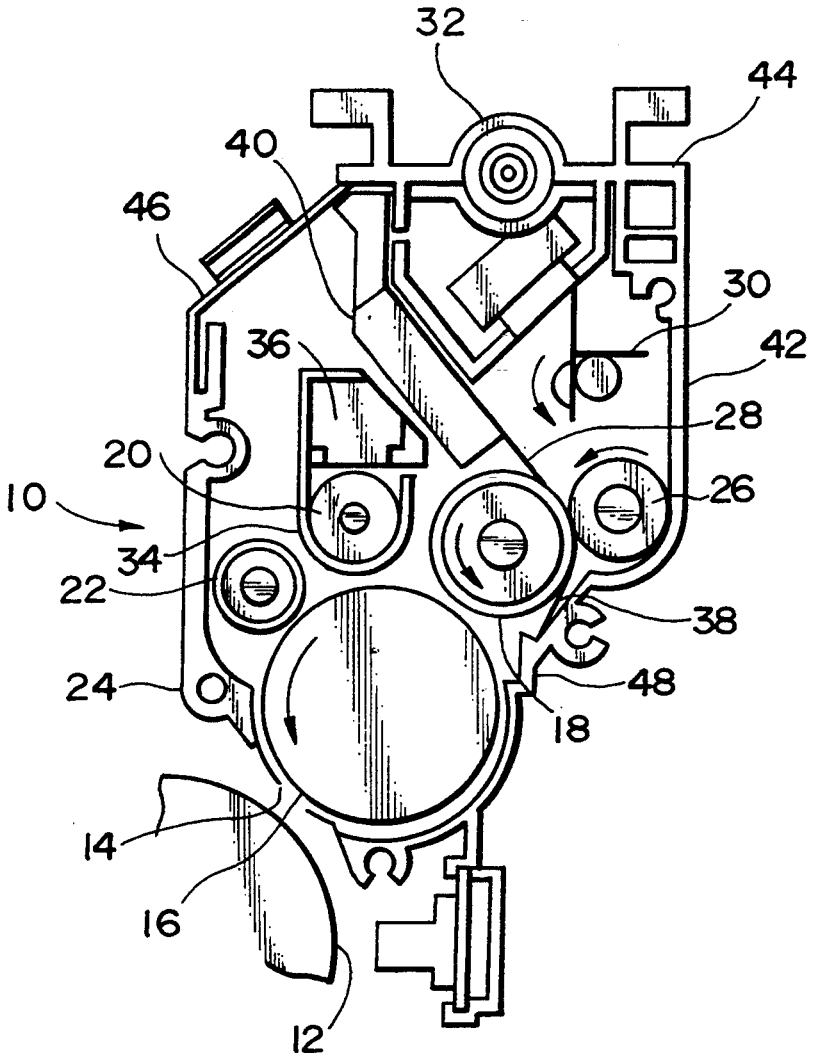
FIG. 1 PRIOR ART
FIG. 1 is a section showing a conventional developing device.

To better understand the present invention, a brief reference will be made to a conventional vertical developing device, shown in FIG. 1. As shown, the developing device, generally 10, has a developing sleeve, or developer carrier, 16 facing an image carrier 12 through an opening 14. The image carrier 12 is implemented as a photoconductive drum by way of example. A plurality of magnets are disposed in the developing sleeve 16. A toner supply roller 18, an upper transport screw 20, a lower transport screw 22, and a doctor 24 are accommodated in the device 10, and each faces the sleeve 16. The transport screws 20 and 22 are used to convey a toner, as will be described. The doctor 24 bifunctions as the left wall of the device 10. A sponger roller 26 for supplying a toner and an elastic blade 28 for thinning a toner layer are held in contact with the surface of the toner supply roller 18. Alternatively, the sponge roller may be comprised of a metallic core, and a conductive webbing wrapped therearound and made of foam polyurethane in which carbon is dispersed An agitator 30 and a toner conveying screw 32 are located above the sponge roller 26. The toner supply roller 18 is made up of a core made of metal, and a surface layer provided on the core and made of nitrile rubber (NBR), silicone rubber or similar rubber or fluoric resin or similar resin. The blade 28 is implemented by a thin sheet of carbon steel or similar metal, silicone rubber or similar rubber, or fluoric resin or similar resin. The materials constituting the rollers 18 and 26 and blade 28 are selected in consideration of, among others, the polarity and amount of charge to deposit on a toner.

The upper screw 20 is surrounded by a trough-like screw casing 34 and rotated in a predetermined direction to convey a developer from the rear to the front, as viewed in the figure, within the casing 34. A developer inlet opening and a developer outlet opening, not shown, are respectively formed through the casing 34 at the rear and the front, respectively, and each extends over about 10 millimeters in the front-and-rear direction. A scooping magnet 36 is disposed above the rear end of the screw 20 and has a length of about 10 millimeters. A developer is introduced into the casing 34 via the inlet opening by the magnetic force of the magnet 36. On the other hand, the lower screw 22 is rotated in a predetermined direction in an accumulation of developer above the developing sleeve 16, thereby conveying the developer from the front to the rear.

In the device 10, a roller seal 38 is affixed to the wall of the device 10 at the lower end thereof and pressed against the toner supply roller 18 at a predetermined pressure at the upper end thereof. The blade 28 has the upper end thereof affixed to a blade holder 40 which is, in turn, affixed to the wall of the device 10 at the upper end thereof. The roller seal 38, toner supply roller 18, blade 28 and blade holder 40 cooperate to partition the device 10 into two chambers, i.e., a developing and agitating chamber accommodating the sleeve 16 and associated members, and a toner storing chamber accommodating the agitator 30 and associated members. A fresh toner is delivered from a toner tank, not shown, to the toner storing chamber by a screw 32. The developing and agitating chamber stores a two-component developer, i.e., a carrier and the toner supplied from the toner storing chamber by the toner supply roller 18.

The toner storing chamber is delimited by a right casing 42 at the right side thereof and by a top cover 44 at the top thereof. On the other hand, the developing and agitating chamber is delimited by a developer inlet cover 46 at the top thereof and by a bottom casing 48 at the bottom thereof.

In operation, the developing sleeve 16 is rotated counterclockwise, as viewed in FIG. 1. As a bias voltage is applied from a bias source, not shown, to the sleeve 16. The sleeve 16 develops a latent image electrostatically formed on the drum 12. As a result, the latent image is converted to a corresponding toner image. When a toner supply clutch, not shown, is coupled, it drives the toner supply roller 18 in the counterclockwise direction. The sponge roller 26, blade and roller seal 38 are each pressed against the toner supply roller 18 over the entire length of the latter. In this condition, the toner existing in the toner storing chamber is rubbed against the toner supply roller 18 by the sponge roller 26 which is rotated together with the roller 18. Consequently, the toner is deposited on and conveyed by the toner supply roller 18 while being regulated in thickness by the blade 28. The resulting thin layer of toner formed on the toner supply roller has been charged by friction. Hence, such a toner is transferred to a developer magnetically deposited on the developing sleeve 16, due to contact and electric effect. As a result, the toner concentration of the developer is increased.

The developer passed through between the developing sleeve 16 and the toner supply roller 18 is brought to a position below the screw casing 34. At this instant, at least part of the developer positioned above the rear end of the sleeve 16 is introduced into the casing 34 by the magnet 36 via the developer inlet opening. This part of the developer is conveyed by the upper screw 20 toward the front end of the device 10 until it drops onto the sleeve 16 via the developer outlet opening. The developer so dropped onto the sleeve 16 and the developer moved away from the bottom of the casing 34 form an accumulation above the sleeve 16 in combination. The lower screw 22 disposed in the accumulation conveys the developer toward the rear end of the device 10. In this manner, the developer agitated by the upper and lower screws 20 and 22 is magnetically retained on and transported by the sleeve 16 toward the drum 12, while having the thickness thereof regulated by the doctor 24.

The conventional device 10 described above allows the toner supply roller 18 to supply a sufficiently charged fresh toner to the developer deposited on the developing sleeve 16. Hence, the interval between the time when the toner is supplied and the time when it is actually used for development is short, enhancing rapid response in toner supply control. In addition, since the frictional charging of the toner scarcely relies on the developer, the total amount of developer required to exist in the device 10 can be reduced. However, this kind of device 10 has various problems left unsolved, as discussed earlier.

Preferred embodiments of the developing device in accordance with the present invention will be described hereinafter. The embodiments are applied to an electrophotographic copier by way of example and have their constituents similar to the constituents of the conventional device 10 designated by the same reference numerals.

Figure 2:
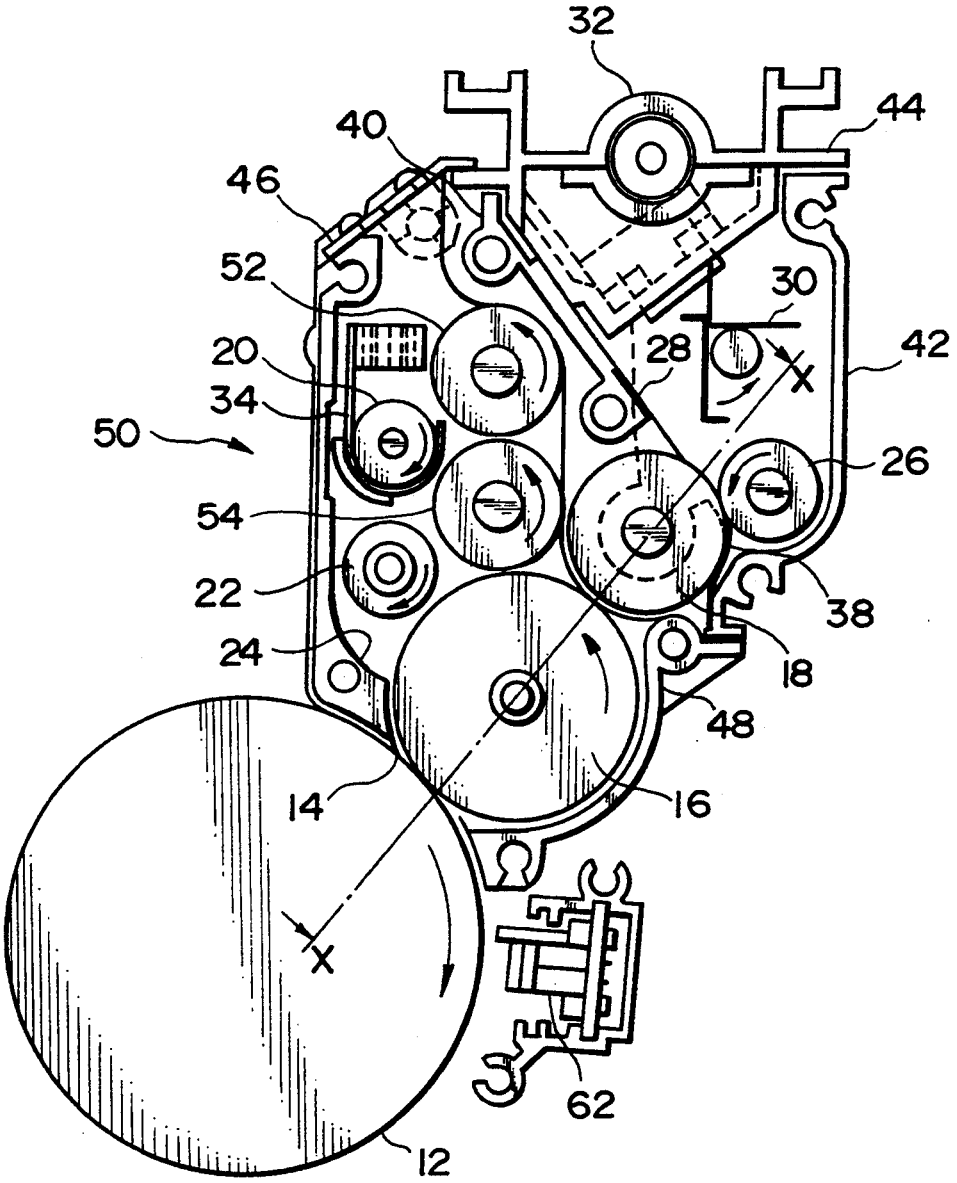
FIG. 2 is a section of a developing device embodying the present invention.

Referring to FIG. 2, a developing device embodying the present invention is shown and generally designated by the reference numeral 50. As shown, the device 50 has a developing sleeve 16 facing a photoconductive drum 12 through an opening 14 and accommodating magnets therein. A toner supply roller 18 and a doctor 24 are accommodated in the device 50, and each faces the developing sleeve 16. A sponge roller 26 for supplying a toner and an elastic blade 28 for thinning a toner layer are held in contact with the surface of the toner supply roller 18. An agitator 30 and a toner conveying screw 32 are located above the sponge roller 26. A roller seal 38, the toner supply roller 18, the blade 28 and a blade holder 40 partition the device 50 into two chambers, i.e., a developing and agitating chamber and a toner storing chamber. A fresh toner is stored in the toner storing chamber while a two-component developer, i.e., a carrier and toner mixture is stored in the developing and agitating chamber. The rollers 18 and 26, blade 28 and so forth may each be made of the same material as the corresponding member of the conventional device 10.

With the above arrangement, the device 50 causes the toner supply roller 18 to supply a sufficiently charged fresh toner to the developer deposited on the developing sleeve 16, thereby enhancing rapid response in toner supply control. In addition, the device 50 reduces the total amount of developer required to exist therein. Besides, the device 50 is capable of enhancing the durability of the developer and the mixability of the toner and developer. For this purpose, the upper and lower screws 20 and 22 of the conventional device 10 are replaced with an upper and a lower transport roller 52 and 54 which constitute developer scooping and transporting means. The screws 20 and 22 are located between the developer scooping and transporting means and the doctor 24.

The upper and lower transport rollers 52 and 54 each accommodates a block magnet having the N and S poles. The rollers 52 and 54 are each rotatable counterclockwise at a linear velocity of, for example, 120 millimeters per second to scoop up and transport the developer from the developing sleeve 16. The arrangement of the block magnets will be described in detail later. The lower roller 54 is located around a part of the surface of the sleeve 16 just above the axis of the sleeve 16, preferably such that the axis of the roller 54 is downstream of the axis of the sleeve 16 with respect to the direction in which the sleeve 16 conveys the developer. Such a location of the lower roller 54 is advantageous for the following reasons. Around the part of the surface of the sleeve 16 just above the axis, the weight of the developer itself can be used to deposit the developer on the sleeve 16. Usually, therefore, it is not necessary to generate an intense magnetic force at such a position. This allows a relatively small block magnet to implement the lower roller 54. Further, the lower roller 54 can scoop up the developer smoothly and frees the developer from excessive stresses ascribable to the wedge-shaped gap between the sleeve 16 and the roller 54. The upper screw 20 is rotatable clockwise in a trough-like screw casing 34 to transport the developer dropped from the upper roller 52 onto the casing 34 toward the rear end of the device 50.

Figure 3A:
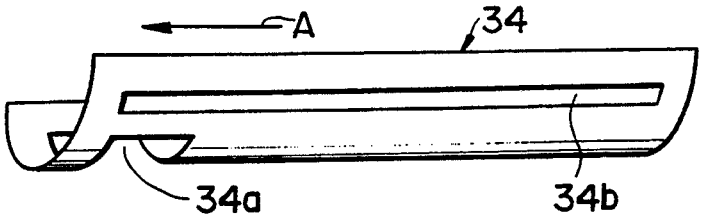
FIGS. 3A–3F are external views each showing a specific configuration of a screw casing included in the embodiment.

Specific configurations of the screw casing 34 will be described with reference to FIGS. 3A–3F. The casing 34 shown in FIG. 3A has an opening **34*a* at the rear end portion (left end portion in the figure) thereof for letting the developer to fall. An elongated overflow slot 34*b* is formed through a side wall of the casing 34 opposite to the upper and lower rollers 52 and 54. In FIG. 3A, the arrow indicates the direction in which the upper screw 20** conveys the developer.

Figure 3B:
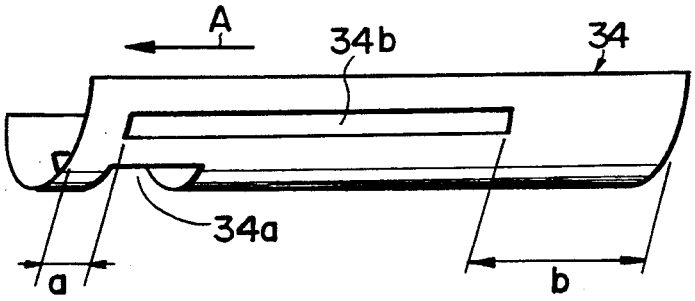
Figure 3C:
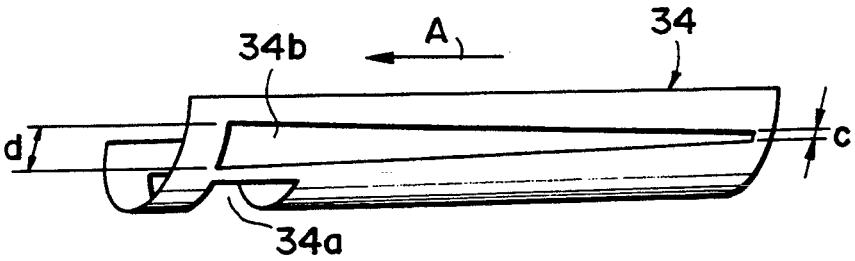
Figure 3D:
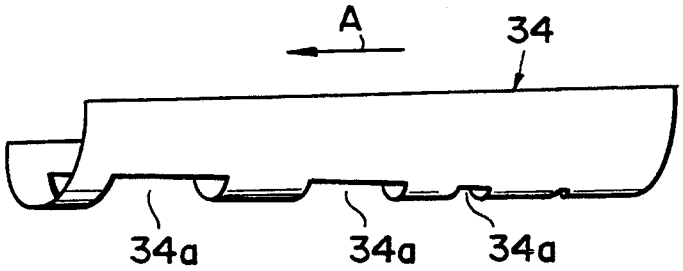
Figure 3E:
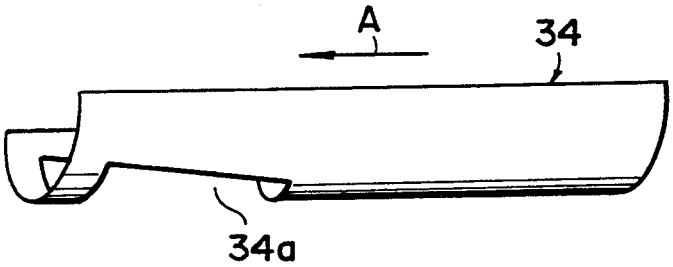
Figure 3F:
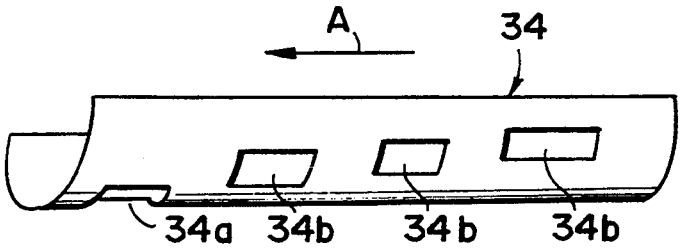

FIGS. 3B–3F each shows another specific configuration of the screw casing 34 having the following characteristic. In FIG. 3B, the overflow slot 34*b* terminates halfway at the front side of the device 50 (b>a) to prevent the developer from overflowing the casing 34 at the front end portion of the device 50. This is successful in eliminating a dead developer due to lateral agitation. In FIG. 3C, the overflow opening 34b sequentially increases in width from the front to the rear of the device 50 (c>d), so that the amount of developer existing in the casing 34 may sequentially decrease from the front to the rear. With this configuration, it is possible to eliminate excessive unbalance in the amount of overflow in the front-and-rear direction; otherwise, the developer would sequentially decrease in amount from the front to the rear in the casing 34. The casing 34 shown in FIG. 3D lacks the overflow opening 34*b* and, instead, has a plurality of openings 34*a* arranged in the front-and-rear direction. The size or area of the openings 34*a* sequentially increases from the front to the rear of the casing 34 to eliminate excessive unbalance in the amount of fall of the developer in the front-and-rear direction; otherwise, the developer would sequentially decrease in amount from the front to the rear in the casing 34. In FIG. 3E, the opening 34*a* at the rear side of the device 50 is provided with a substantial length, and the slot 34*b* is omitted. The size or area of this opening 34*a* also sequentially increases toward the rear end of the device 50 to eliminate excessive unbalance in the amount of fall of the developer in the front-and-rear direction; otherwise, the developer would sequentially decrease in amount from the front to the rear in the casing 34. Further, in FIG. 3F, a plurality of overflow slots 34*b* are formed through the casing 34 and arranged in the front-and-rear direction. The level or height of the slots 34*b* is sequentially lowered from the front to the rear of the device 50 to eliminate excessive unbalance in the amount of fall of the developer in the front-and-rear direction; otherwise, the developer would sequentially decrease in amount from the front to the rear in the casing 34.

The lower screw 22 is rotated counterclockwise in the accumulation of developer above the sleeve 16 to convey the developer from the front to the rear of the device 50. The lower screw 22 is provided with a spiral diameter and a spiral pitch greater than those of the upper screw 20. Specifically, the developer in the accumulation around the lower screw 22 is greater in amount than the developer in the screw casing 34 (subspace for agitation) surrounding the upper screw 20. In the light of this, the lower screw 22 is provided with higher conveyability than the upper screw 20 to insure both the front-and-rear balance in the lateral agitation of the developer and the desirable developer and toner mixture. To further promote the mixture, the lower screw 22 may be rotated at a higher speed than the upper screw 20.

Figure 4:
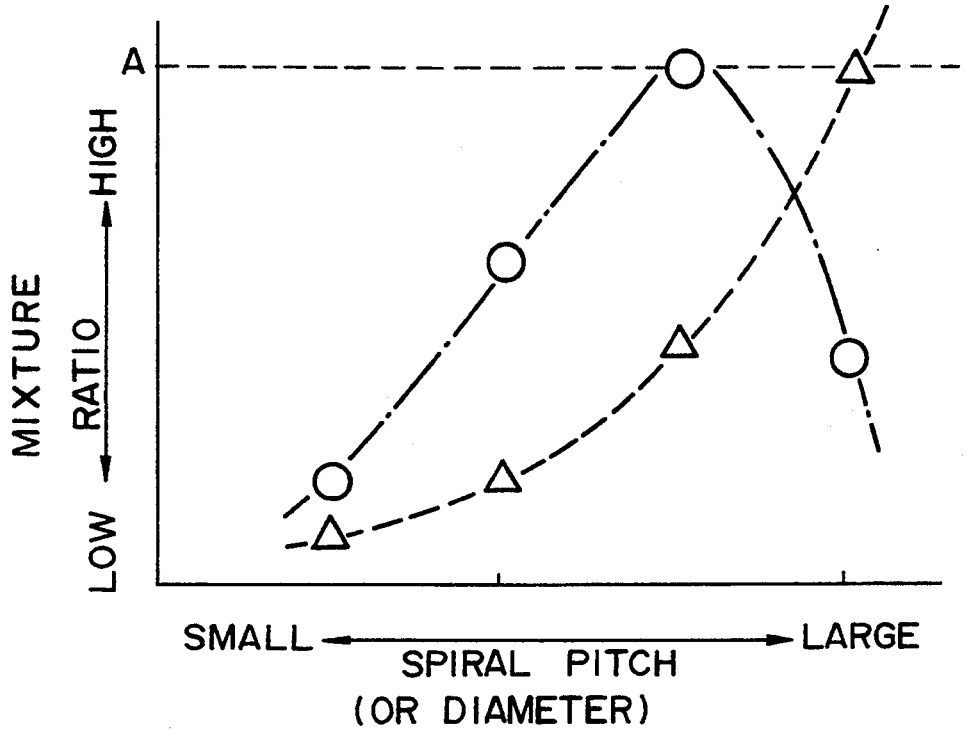
FIG. 4 is a graph indicative of a relation between the mixture ratio of a developer and the spiral pitch or spiral diameter.
Figure 5:
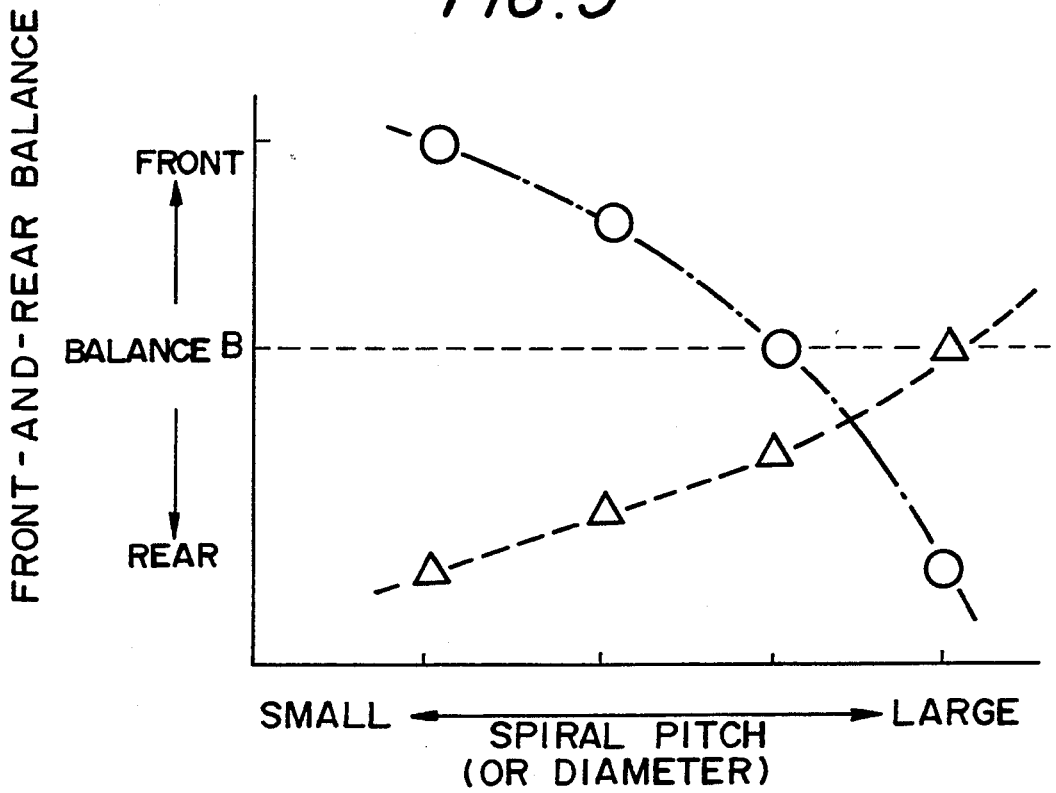
FIG. 5 is a graph indicative of a relation between the front-and-rear balance of a developer associated with lateral agitation and the spiral pitch or spiral diameter.

The lower screw 22 has a greater spiral diameter and a greater spiral pitch than the upper screw 20, as stated above. Such a configuration of the screw 22 is to maintain a predetermined mixture ratio of the developer and the front-and-rear balance in the lateral agitation of the developer. FIG. 4 shows a relation between the spiral pitch or spiral diameter and the mixture ratio of the developer determined by experiments with the two screws 20 and 24. As shown, at a point A where the mixture ratio available with the upper screw 20 (indicated by circles) is maximum, the spiral pitch and spiral diameter of the lower screw 22 (indicated by triangles) are greater than those of the screw 20. FIG. 5 shows a relation between the spiral pitch or spiral diameter and the front-and-rear balance of the developer also determined by experiments with the screws 20 and 22. As FIG. 5 indicates, at a point B where the front-and-rear balance is optimal, the lower screw 22 (indicated by triangles) has a greater spiral pitch and a greater spiral diameter than the upper screw 24 (indicated by circles).

Figure 6:
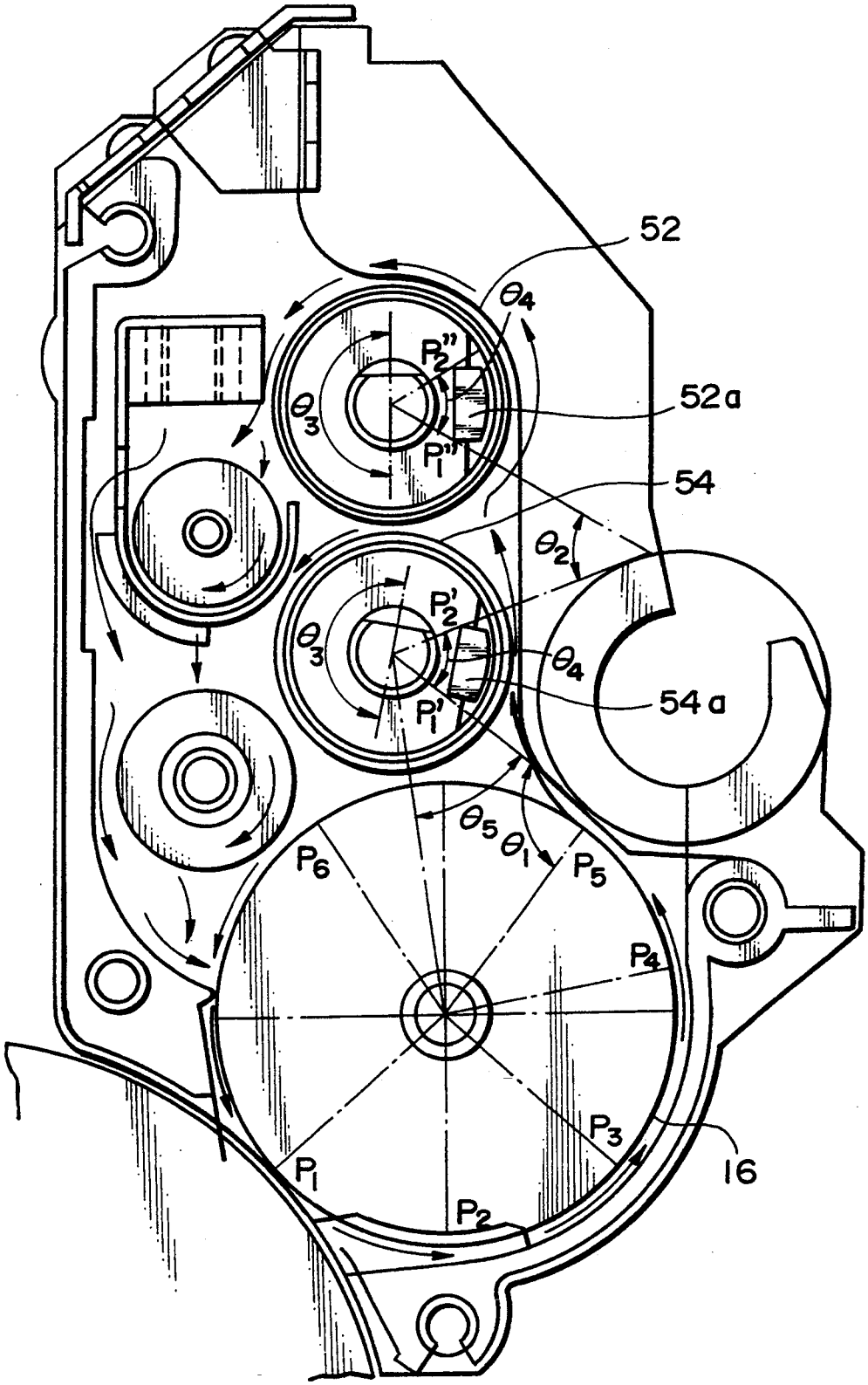
FIG. 6 is a section showing the arrangement of a developing sleeve, an upper and a lower transport roller and so forth included in the embodiment, together with the flow of a developer.

Referring to FIG. 6, block magnets 52*a* and 54*a* are accommodated in the upper and lower transport rollers 52 and 54, respectively. The figure shows a condition wherein the lower roller 54 scoops up all the developer from the developing sleeve 16; arrows are indicative of the flow of the developer. Dash-and-dot lines radially extending from the axis of the sleeve 16 and accompanied by symbols $P_1$–$P_6$ are representative of the angular directions of the peak points of magnetic force measured by locating a sensor in the vicinity of the surface of the sleeve 16. The peak point $P_5$ magnetically adjoining the lower roller 54 is the N pole. The magnets 52*a* and 54*a* are fixed in place inside of the rotatable sleeves of the rollers 52 and 54, respectively. Dash-and-dot lines extending radially from the axes of the rollers 52 and 54 and accompanied by symbols $P_1'$, $P_2'$, $P_1''$ and $P_2''$ are representative of the angular directions of the peak points of magnetic force measured by locating a sensor in the vicinity of the surfaces of the rotatable sleeves of the rollers 52 and 54. The lower peak point $P_1'$ and the upper peak point $P_2'$ of the lower roller 54 are the S pole and the N pole, respectively. The lower peak point $P_1''$ and the upper peak point $P_2''$ of the upper roller 52 are the S pole and the N pole, respectively.

The angular direction of the peak point $P_5$ of the sleeve 16 which magnetically adjoins the lower roller 54 and the angular direction of the lower peak point $P_1'$ of the roller 54 intersect each other at an angle $\theta_1$ at the smaller angle side. The angle $\theta_1$ is selected to lie in the range of 80 degrees to 100 degrees. Excessively small angles $\theta_1$ would make it difficult to scoop up the developer while excessively great angles would subject the developer to excessive stresses. The angular direction of the upper peak point $P_2'$ of the lower roller 54 and the lower peak point $P_1''$ of the upper roller 52 intersect each other at an angle $\theta_2$ at the smaller angle side. The angle $\theta_2$ ranges from 30 degrees to 70 degrees; excessively small angles would make it difficult to scoop up the developer while excessively great angles would subject the developer to excessive stresses. $\theta_3$ is representative of an angle over which the magnetic force measured on the surface of the rotatable sleeve of each roller 52 or 54 is substantially zero gauss. This angle $\theta_3$ is selected to be 90 degrees to 200 degrees and used to separate the developer scooped up from the rotatable sleeve and to eliminate the adverse influence of, among the others, the upper screw 20 on lateral agitation. The angular directions of the upper and lower peak points of each roller 52 or 54 intersect each other at an angle $\theta_4$ at the smaller angle side. The angle $\theta_4$ is selected to be 45 degrees to 90 degrees; excessively small angles would make it difficult to scoop up the developer while excessively great angles would subject the developer to excessive stresses. Further, assume a reference line extending from the axis of the lower roller 54 to the axis of the sleeve 16, as illustrated. Then, the angle of the magnet 54a of the lower roller 54 may be represented by $\theta_5$ which is the angle between the angular direction of the lower peak point $P_1'$ and the reference line. By adjusting the angle $\theta_5$, it is possible to adjust the amount of developer to be scooped up from the sleeve 16 by the lower roller 54, as will be described specifically later.

To reduce the stresses on the developer, the sleeve 16 and the lower roller 54 may advantageously be rotated at substantially the same linear velocity. The peak points should preferably be selected such that there hold relations $P_1' > P_2'$, $P_1'' > P_2'$ and $P_1'' > P_2''$, in order to promote smooth transfer of the developer. Furthermore, it is preferable to provide the magnets 52a and 54a of the rollers 52 and 54 with a length greater than the length of a magnet built in the sleeve 16 and forming the peak point $P_5$, so that the dead agent to leak from the end of the sleeve 16 may be eliminated. Experiments showed that the developer is sufficiently agitated and the developer suffers from a minimum of stress when the angles $\theta_1$, $\theta_2$, $\theta_3$ and $\theta_4$ are 93.5 degrees, 51.5 degrees, 180 degrees and 62 degrees, respectively, the peak points $P_5$, $P_1'$, $P_2'$, $P_1''$ and $P_2''$ are 750 gausses, 500 gausses, 500 gausses, 450 gausses and 450 gausses, respectively, and the upper and lower rollers 52 and 54 are each rotated at a linear velocity of 120 millimeters per second.

In operation, the developing sleeve 16 is rotated counterclockwise and applied with a bias voltage from a bias source, not shown, to develop a latent image formed on the drum 12. As a result, the latent image is converted to a corresponding toner image. When a toner supply clutch, not shown, is coupled, it drives the toner supply roller 18 in the counterclockwise direction. The sponge roller 26, blade 28 and roller seal 38 are each pressed against the toner supply roller 18 over the entire length of the latter. In this condition, the toner existing in the toner storing chamber is rubbed against the toner supply roller 18 by the sponge roller 26 which is rotated together with the roller 18. Consequently, the toner is deposited on and conveyed by the toner supply roller 18 while being regulated in thickness by the blade 28. The resulting thin layer of toner formed on the toner supply roller has been charged by friction. Hence, such a toner is transferred to a developer magnetically deposited on the developing sleeve 16, due to contact and electric effect. As a result, the toner concentration of the developer is increased. The developer passed through between the sleeve 16 and roller 18 is substantially entirely scooped up by the lower transport roller 54 due to magnetism at a position where it faces the roller 54. The upper toner transport roller 52 scoops up the developer from the lower roller 54. As the roller 52 transports the developer to a position where no magnetic forces act and defined on the casing 34 side, it drops from the roller 52 over the entire width due to gravity like a waterfall. As a result, the developer is received by the casing 34 and transported to the rear of the device 50 by the upper screw 20. This part of the developer drops from casing 34 through the opening or openings 34a stated earlier. At the same time, a part of the developer received by the casing 34 drops through the overflow slot 34b. The developer dropped through the openings 34a and 34b form an accumulation above the sleeve 16 and is conveyed to the rear of the device 50 by the lower screw 22 disposed in the accumulation. The developer sufficiently cross-mixed by the two screws 20 and 22 is magnetically deposited on and transported by the sleeve 16 to the position where the sleeve 16 faces the drum 12, while being regulated in thickness by the doctor 24.

How the angle $\theta_5$ of the block magnet 54a of the lower roller 54 is adjustable to adjust the amount of developer to be scooped up from the sleeve 16 will be described hereinafter.

Figure 7A:
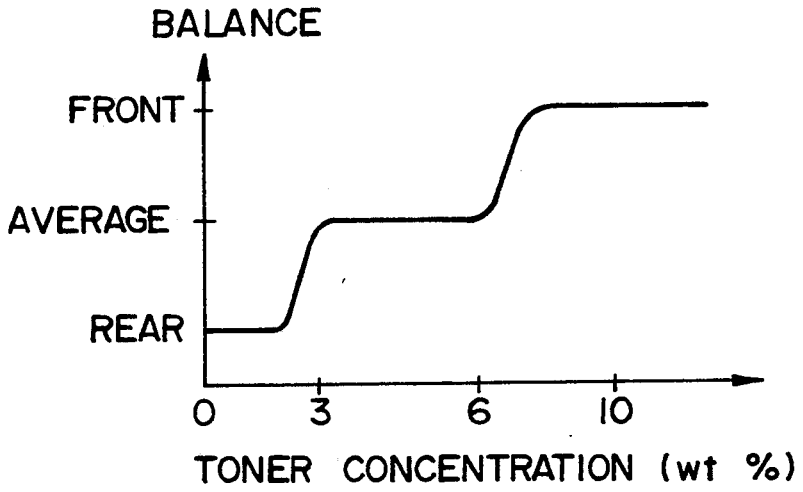
FIG. 7A is a graph indicative of a relation between the toner concentration and the balance of the developer particular to the embodiment.
Figure 7B:
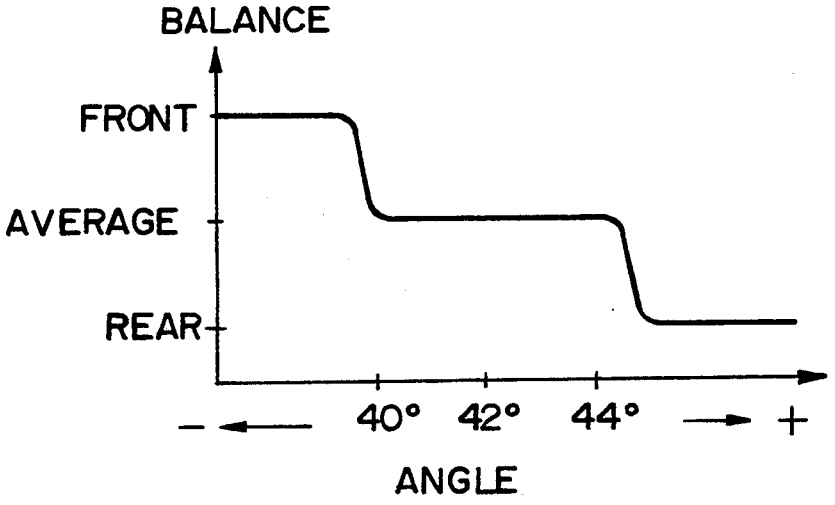
FIG. 7B is a graph indicative of a relation between the angle of a magnet disposed in the lower transport roller and the balance of a developer.

The agitation of the developer by the two screws 20 and 22 and two rollers 52 and 54 relies on the optimal balance between lateral agitation implemented by the screws 20 and 22 and vertical transport implemented by the rollers 52 and 54. The balance is effected by the volume of the developer existing in the device 50. Specifically, as shown in FIG. 7A, as the toner concentration and, therefore, the volume of the developer changes (the higher the toner concentration. The greater the volume of the developer), the front-and-rear balance of the developer in the device 50 changes. When the balance is lost, the developer leaks to the outside of the device 50 at the concentrated side while defective development occurs at the scarce side due to the short developer on the sleeve 16. The developer scooped up from the sleeve 16 by the lower roller 54 is dropped into the casing 34 via the upper roller 52, transported to the rear of the device 50 by the upper screw 20, and then transported to the front by the lower screw 22. On the other hand. The developer left on the sleeve 16 without being caught by the roller 54 is transported to the position where the sleeve 16 faces the lower screw 22, and transported only to the front of the device 50 by the screw 22. It follows that the front-and-rear balance can be adjusted if the amount of developer to be scooped up from the sleeve 16 by the lower roller 54 is changed by changing the angle $\theta_5$ of the magnet 54a. FIG. 7B indicates how the front-and-rear balance changes when the angle $\theta_5$ is increased or decreased from the angle $\theta_5$ shown in FIG. 6 (=42 degrees) within a predetermined range.

Figure 8:
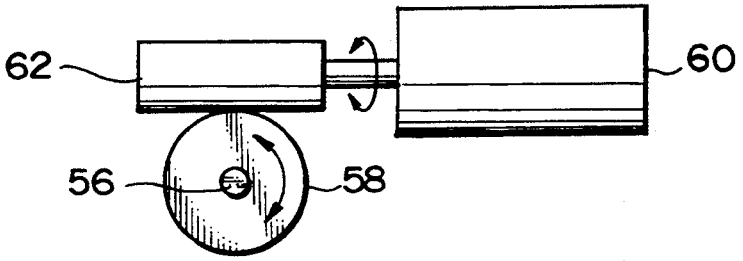
FIG. 8 shows a specific arrangement for adjusting the angle of the magnet.

FIG. 8 shows a specific mechanism for adjusting the angle $\theta_5$ as described above. As shown, a holder, not shown, holding the magnet 54a is rotatably supported by a shaft 56. A worm wheel 58 is affixed to the shaft 56 and driven by a worm 62 which is mounted on the output shaft of a DC motor 60. The angle $\theta_5$ may be adjusted automatically in response to an output of a photosensor, FIG. 2, representative of the density of a reference toner image. Alternatively, the angle $\theta_5$ may be adjusted by a serviceman manually.

The device 50 is also provided with an implementation for facilitating the cleaning and replacement of the toner supply roller 18 and blade 28, as follows. The toner supply roller 18 and blade 28, which need cleaning and replacement, are difficult to clean or replace since they are remote from the opening 14 of the device 50, as discussed earlier. Moreover, since the roller 18 and blade 28 play the role of a wall defining the developing and agitating chamber and the toner storing chamber, it is likely that the toner in the toner storing chamber and the two-component developer in the developing and agitating chamber are mixed together in the event of cleaning or replacement. To facilitate the replacement and cleaning of the roller 18 and blade 28, a pair of side walls included in the device 50 are divided into two pairs such that the roller 18 and blade 28 are exposed between the pair of side walls while being held by them. At the same time, the pair of side walls are divisible into two pairs such that the toner storing chamber of the device 50 is maintained as it is. Such an implementation will be described with reference to FIGS. 9 and 10.

Figure 9:
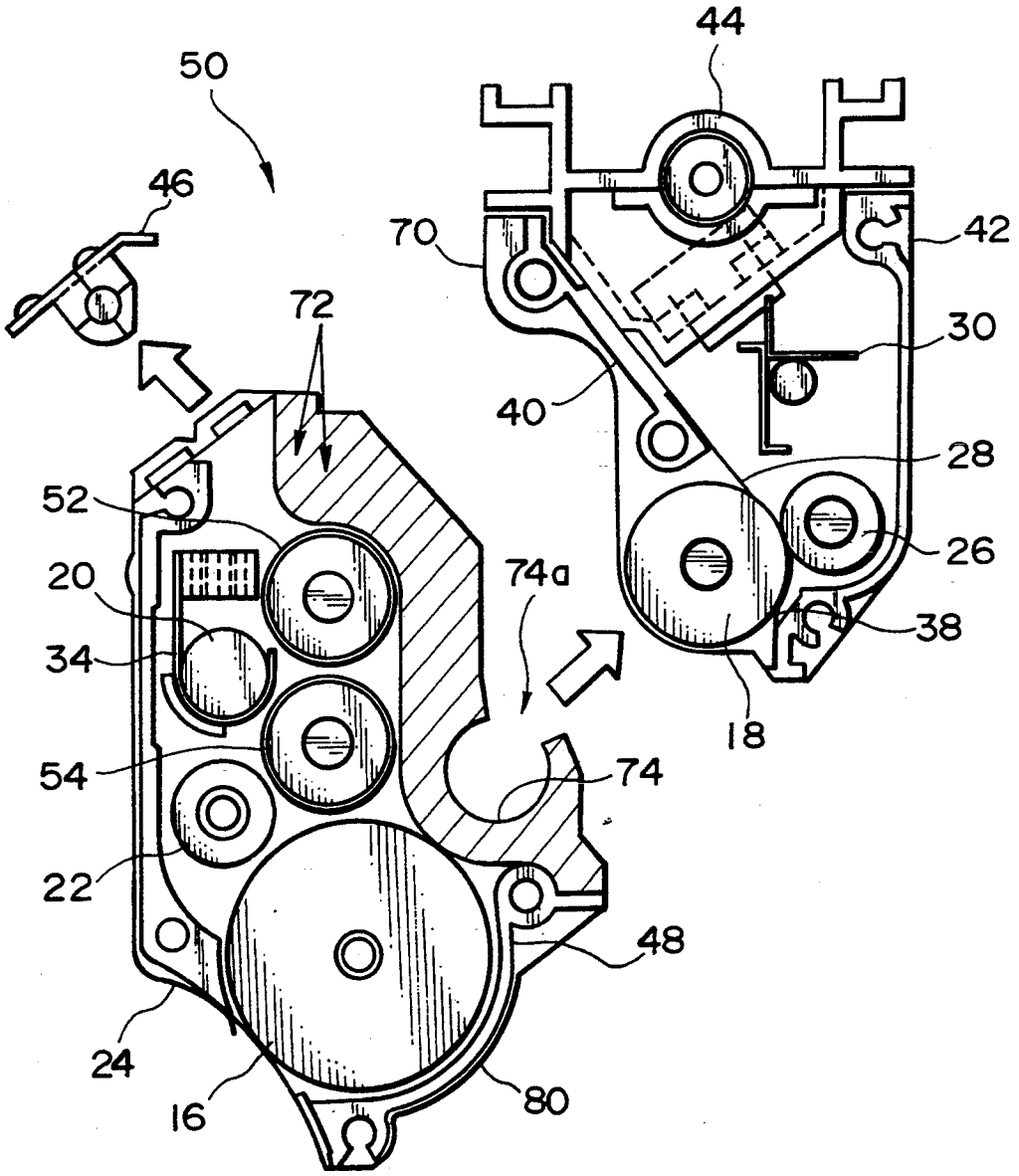
FIG. 9 is a section showing the embodiment in a condition divided into two side wall pairs.
Figure 10:
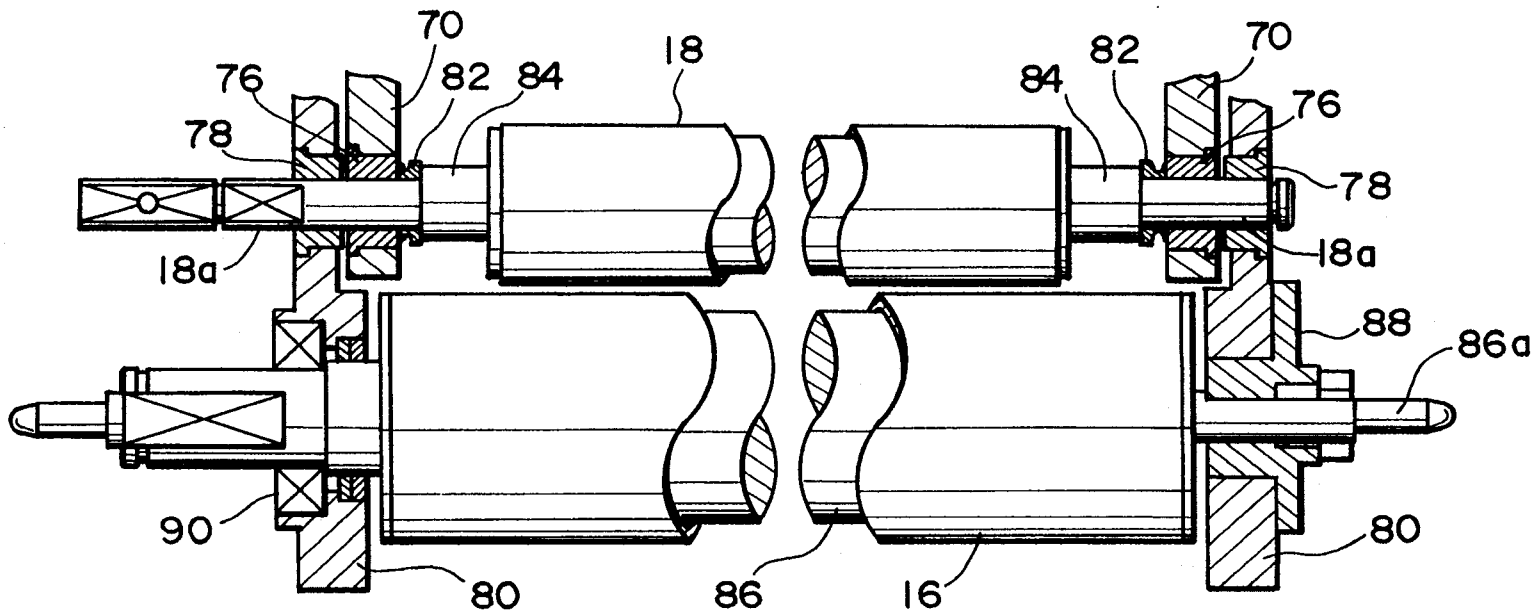
FIG. 10 is a section showing a specific arrangement for supporting a toner supply roller also included in the embodiment.

FIG. 9 shows the pair of side walls of the device 5 0 divided into a side wall pair 70 assigned to a supply unit and a side wall pair 80 assigned to a development and agitation unit. FIG. 10 shows a specific arrangement for supporting the toner supply roller 18. As shown in FIG. 9, the side wall pair of the device 50 is divided in the vicinity of opposite sides of the blade 28 and blade holder 40 with respect to the widthwise direction. The divided side wall pairs overlap each other at opposite sides of the toner supply roller 18 with respect to the axial direction (in the figure, hatching 72 is representative of the overlapping portion of the side wall pair 80). A hole 74 is formed in each of the overlapping portions to receive a bearing. In this manner, the side wall pairs 70 and 80 are implemented as members independent of each other.

The side wall pair 70 associated with the supply unit forms the side walls of the toner storing chamber, or developer storing section, and holds various members disposed in the chamber. Specifically, the toner supply roller 18, blade holder 40, agitator 30 and so forth are removably mounted on the side wall pair 70. Also removably mounted on the side wall pair 70 are the right casing 42 carrying the roller seal 38, and the top cover 44. The side wall pair 70, toner supply roller 18, roller seal 38 contacting the roller 18 in the axial direction, right casing 42, top cover 44, blade holder 40 and blade 28 constitute a wall closing the toner storing chamber. The roller 18 is rotatably supported not only by the side wall pair 70 but also by the side wall pair 80, as will be described later.

The side wall pair 80 associated with the development and agitation unit forms a wall closing the developing and agitating chamber and holds various members disposed in the chamber. Specifically, the developing sleeve 16, rollers 52 and 54, screws 20 and 22, screw casing 34, doctor 24, cover 46 and bottom casing 48 are removably mounted on the side wall pair 80. The toner supply roller 18 is supported by bearings 78, FIG. 10, at axially opposite ends thereof. The bearings 78 are respectively received in the holes 74 formed in the overlapping portions 72. A notch 74*a* is contiguous with each hole 74 and provided with a width great enough to receive the shaft portion 18*a* of the toner supply roller 18. The cover 46 plays the role of a locking member when the two side wall pairs 70 and 80 are coupled together.

A specific mechanism for causing the side wall pairs 70 and 80 to support the toner supply roller 18 will be described with reference to FIG. 10, which is a section along line X—X of FIG. 2. As shown, bearings 76 are removably mounted on the opposite shaft portions 18*a* of the toner supply roller 18 and received in the holes 74 of the side wall pair 70. The roller 18 is supported by the side wall pair 70 via the bearings 61. The previously mentioned bearings 78 are also removably mounted on the shaft portions 18*a* and received in the holes 74 of the other side wall pair 80. Therefore, the roller 18 is also supported by the side wall pair 80 via the bearings 78. Ring seals 82 are respectively mounted on the shaft portions 18*a*, and each intervenes between the end of a larger diameter portion 84 of the associated shaft portion 18*a* in the device 50 and the inner surface of the adjoining side wall 70. The ring seals 82 prevent the toner from penetrating into the bearings 76. A magnet roller 86 is accommodated in the developing sleeve 16 and supported by the side wall pair 80 via a shaft 86*a* and an adjuster 88. The developing sleeve 16 is supported and positioned by bearings 90 press fitted in the side wall pair 80 and is driven by a gearing, not shown.

To clean or replace the toner supply roller 18 or the blade 28, the cover 46 locking the two side wall pairs 70 and 80 is removed. Then, the two bearings for the roller 18 which are mounted on the side wall pair 80 and also lock the side wall pairs 70 and 80 are removed. Subsequently, the side wall pairs 70 and 80 are moved away from each other with the side wall pair 70 holding the roller 18, such that the shaft portions 18*a* of the roller 18 pass through the notches 74*a* contiguous with the holes 74 of the side wall pair 80. As a result, the supply unit and the development and agitation unit are separated from each other.

In this condition, the two side wall pairs 70 and 80 are spaced apart from each other in the vicinity of the opposite sides of the blade 28 with respect to the widthwise direction. Hence, the blade 28 and roller 18 are freely accessible for cleaning or replacement through between the side wall pairs 70 and 80, while being retained by the side wall pairs 70 and 80.

The roller 18, roller seal 38 contacting the roller 18, and blade 28 are mounted on the side wall pair 70 and form another wall of the toner storing chamber. Therefore, even when the device 50 is divided into two, the wall formed by such members maintains the toner storing chamber defined by the side wall pair 70 as it is. For example, the roller 18 is held in contact with the blade 28 and roller seal 38 in the original condition. This prevents the toner from leaking from the supply unit to the development and agitation unit at the beginning of the separation of the two units or from leaking during the separation and contaminating the surrounding. In addition, the roller 18, roller seal 38 and blade 28 which separate the toner storing chamber from the developing and agitating chamber before separation serve as the wall of the toner storing chamber in the separated condition. This eliminates the need for an extra wall member and, therefore, reduces the overall size of the device 50.

Figure 11:
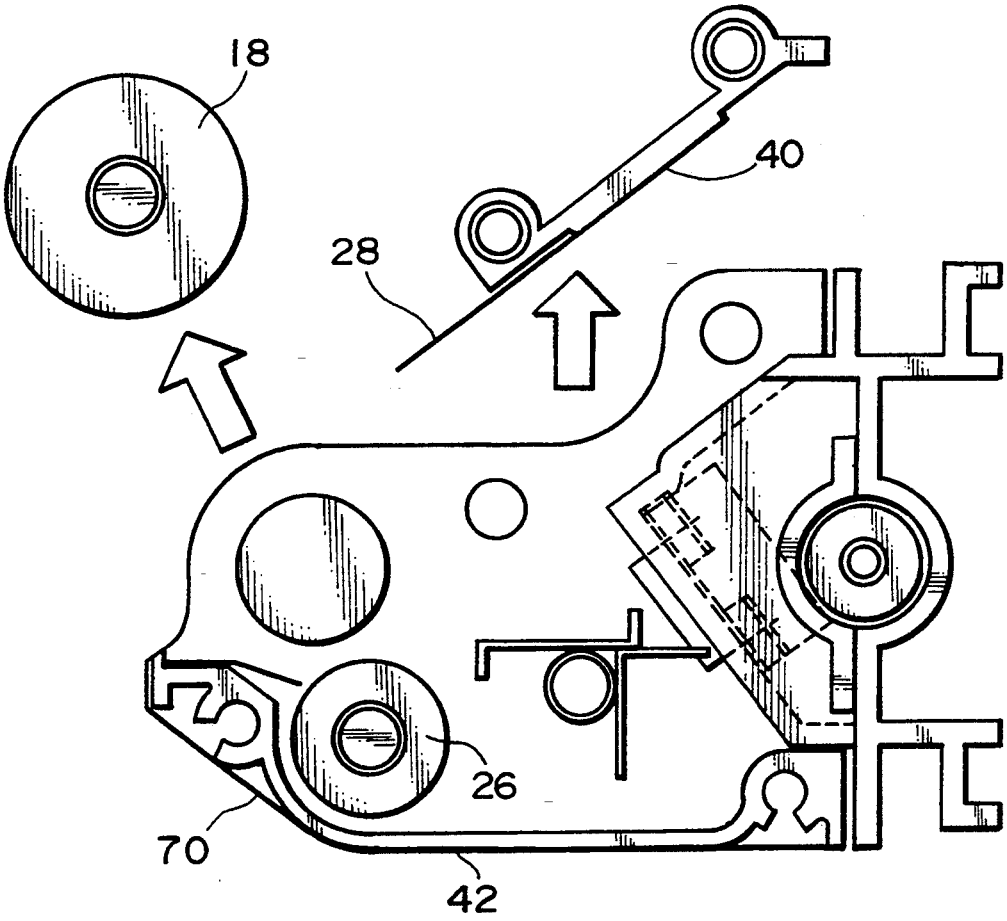
FIG. 11 shows how the toner supply roller is removed from associated one of the two side wall pairs together with a blade holder.

As shown in FIG. 11, in the event of cleaning or replacement of the blade 28, the supply unit may be laid on the floor or similar stable base with the right casing 42 facing downward. Then, the blade 28 can be removed together with the blade holder 40 exposed to the outside between the side wall pair 70. Since the opening of the supply unit faces upward, the toner is prevented from leaking to the outside. To replace or clean the toner supply roller 18, the two bearings 76 received in the holes 74 of the side wall pair 70 are removed from the shaft portions 18*a* of the roller 18 and the holes 74. After the cleaning or replacement of the roller 18 and blade 28, the bearings 76 and 78 and side wall pairs 70 and 80 are sequentially assembled in the reverse order to reconstruct the device 50.

The positional accuracy of the toner supply roller 18 and the sponge roller 26 and blade 28 relative to each other should be secured; otherwise, it would effect the amount and charge of the toner forming the thin layer on the roller 18. In the illustrative embodiment, the rollers 18 and 26 and blade 28 are held by the same side wall pair 70 and, therefore, accurately positioned even after the side wall pairs 70 and 80 have been coupled again. On the other hand, the accuracy of the gap between the developing sleeve 16 and the toner supply roller 18 effects the amount of toner supply to the developer deposited on the sleeve 16. In this embodiment, since the roller 18 is supported and positioned not only by the side wall pair 70 but also by the side wall pair 80 via the bearings 78, the accuracy of the gap is insured even after the coupling of the side wall pairs 70 and 80. In this manner, the device 50 is separable to expose the roller 18 and blade 28 to the outside while maintaining the required accuracy.

Figure 12:
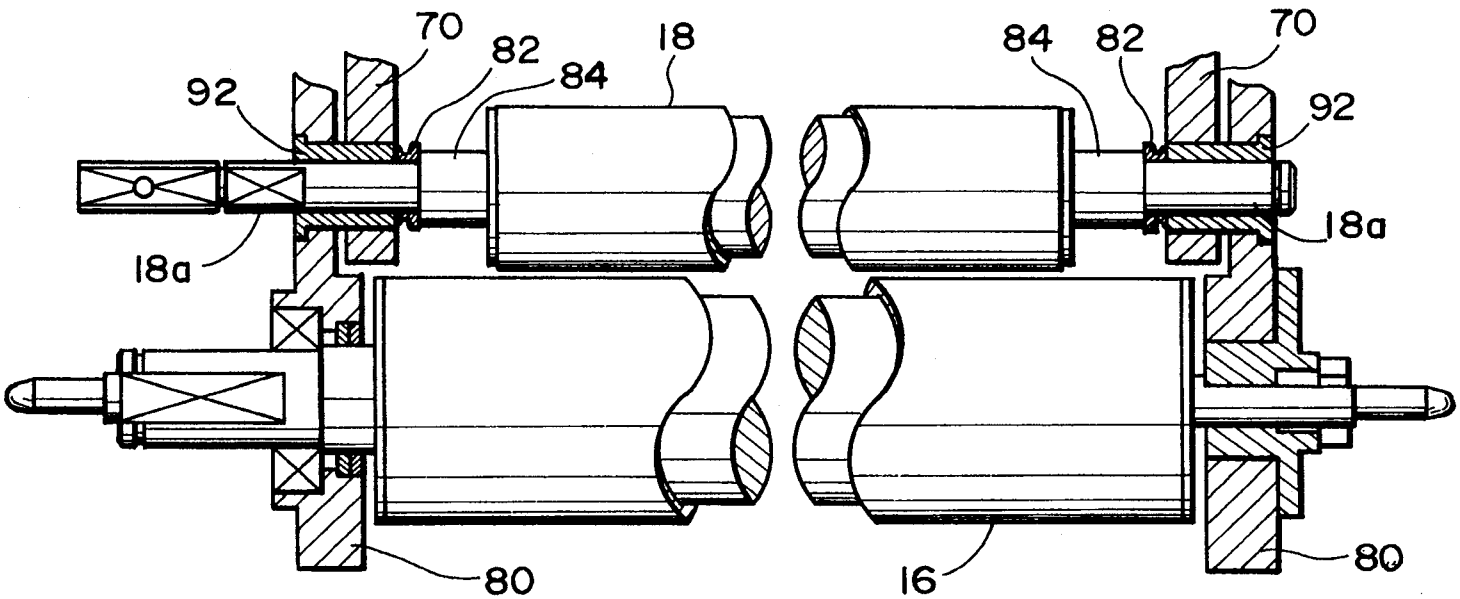
FIGS. 12 and 13A–13C each shows another specific arrangement for supporting the toner supply roller.

Referring to FIG. 12, another specific mechanism for causing the side wall pairs 70 and 80 to support the toner supply roller 18 will be described. As shown, bearings 92 are removably mounted on the opposite shaft portions 18*a* of the toner supply roller 18 and passed through the the holes 74 of the side wall pair 80 and further passed through the holes 74 of the other side wall pair 70. Therefore, the roller 18 is supported by the side wall pairs 70 and 80 via the bearings 92. In FIG. 12, the same constituent parts as the parts shown in FIG. 10 are designated by the same reference numerals. To clean or replace the roller 18, the two bearings 92 received in the holes 74 of the overlapping portions 721 of the side wall pair 80 are removed from the shaft portions 18*a* of the roller 18 and the holes 74. Then, the supply unit and the development and agitation unit are moved away from each other with the roller 18 loosely held by the side wall pair 70, such that the shaft portions 18*a* of the roller 18 pass through the notches 74*a*.

The configuration shown in FIG. 12 has the following advantages. The bearings 92 support the shaft portions 18*a* of the roller 18 over an area greater than the support area available with each of the two pairs of bearings 76 and 78 of the previous mechanism, thereby reducing the play between the bearings 92 and the shaft portions 18*a*. When the weight of the supply unit is received by the side wall pair 80 via the shaft portions 18*a* of the roller 18, it is also received over a broader area than by the bearings 78. Since the bearings 92 are supported by the side wall pairs 70 and 80, the distortion of the front and rear side walls to unavoidably occur in each of the two combined units can be corrected by the mating of the periphery of the bearings 92, and in addition the bending stress acting on the shaft portions 18*a* of the roller 18 is reduced.

Figure 13A:
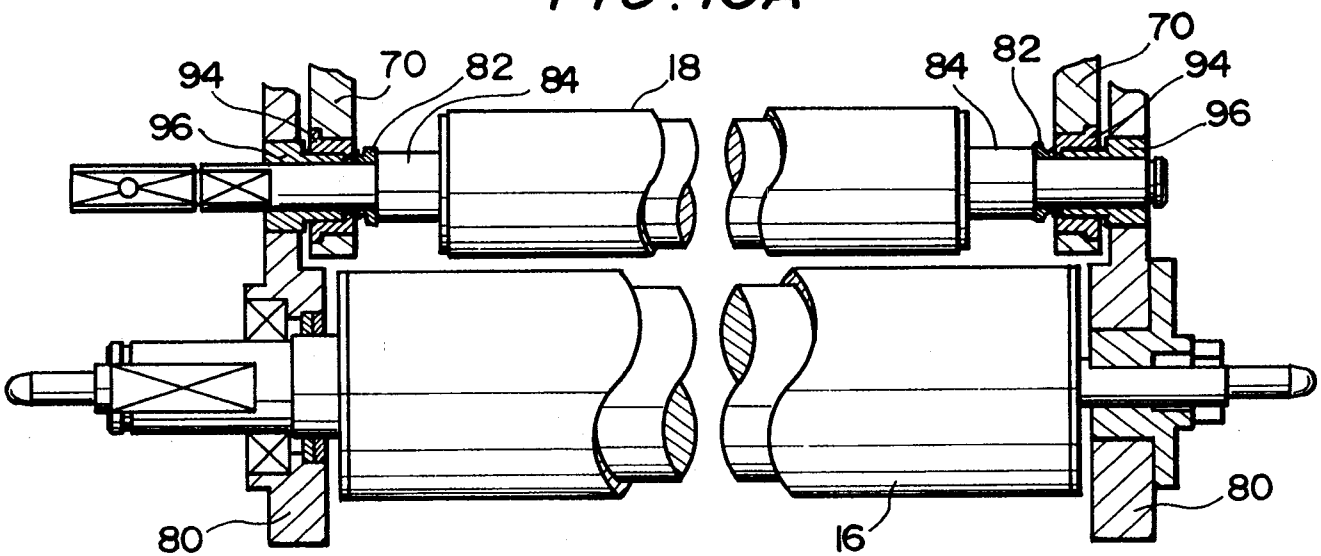
Figure 13C:
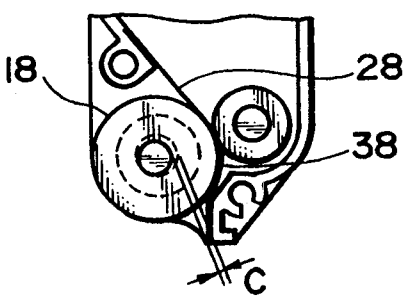
Figure 13B:
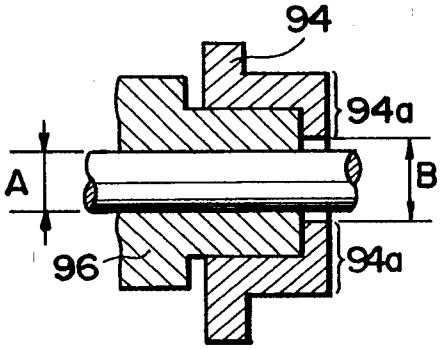

FIGS. 13A–13C show still another specific mechanism for causing the side wall pairs to support the toner supply roller 18. As shown, bearing housings 94 are respectively received in the holes 74 of the side wall pair 70, and each is formed with a bore. Bearings 96 for supporting the shafts 18*a* of the roller 18 are respectively received in the bores of the bearing housings 94. The housings 94 each has an end 94*a* broad enough to cover substantially the entire inner end of the associated bearing 96. The shaft portions 18*a* of the roller 18 are respectively passed through holes formed through the ends 94*a* of the bearing housings 94. As shown in FIG. 13B, each hole formed through the housing end 94*a* has a diameter B greater than the diameter A of the shaft portion 18*a* of the roller 18. The difference between the diameters A and B (A–B) is selected such that when the bearing 96 is removed from the housing 94, the displacement C, FIG. 13C, of the shaft portion 18*a* in the direction perpendicular to the axis lies in a range which maintains the roller seal 38 and blade 28 in contact with the roller 18. In this sense, the wall of the housing 94 forming the hole serves as a portion which restricts the position of the shaft 18*a* when the bearing 94 is removed.

In the arrangement of FIGS. 13A–13C, to clean or replace the toner supply roller 18, the two bearings 96 passed through the holes 74 of the overlapping portions 72 of the side wall pairs 70 and 80 and the holes of the bearing housings 94 are removed from the shaft portions 18*a* of the roller 18 and the holes 74. Then, the two units are moved away from each other with the side wall unit 70 loosely holding the roller 18, such that the shaft portions 18*a* of the roller 18 pass through the notches 74*a*. Further, the roller 18 may be removed after removing the bearing housings 94 from the side wall pair 70.

The arrangement of FIGS. 13A–13C has the following advantages. Even when the bearings 96 are removed to separate the two units by the above procedure, the ends of the bearing housings 94 abut against the ring seals 82 fitted on the shaft portions 18*a* of the roller 18 and, therefore, restrains the roller 18 from sliding relative to the side wall pair 70 along the axis of the roller 18. This prevents the roller seal 38 and blade 28 from being turned over and, at the same time, prevents the toner from leaking at the neighborhood of the shaft portions 18*a* of the roller 18.

When the bearings 96 are removed to separate the supply unit and the development and agitation unit, the roller 18 is displaced in the direction perpendicular to the axis thereof due to gravity and the force of the blade 28, as illustrated in FIG. 13C. However, since the bearings 18*a* abut against the walls of the holes of the bearing housings 94, the displacement C is confined in a range which maintains the roller seal 38 and blade 28 in elastic contact with the roller 18. As a result, the toner is prevented from leaking through between the roller 18 and the roller seal 38 and blade 28.

Even when the supply unit and the development and agitation unit are held in the coupled condition, the ends 94*a* of the bearing housings 94 each covers substantially the entire inner end of the associated bearing 96 received in the hole 74 of the side wall pair 70. Hence, the developer existing in the developing and agitating chamber is prevented from contacting the bearings 96, whereby the leak of the bias via the developer is eliminated. This allows the bearings 96 to be implemented by sintered metal or similar metal highly resistive to wear. In addition, there are eliminated the adhesion of the toner and the deterioration of the ring seals 82 ascribable to oil otherwise coming out of the bearings 96.

The bearings 96 have been shown and described as being passed through the holes 74 of the side wall pair 80 and further passed through the holes of the side wall pair 70, as in the arrangement of FIG. 12. If desired, the beatings 96 may be replaced with two pairs of bearings 76 and 78 shown in FIG. 10.

Figure 14:
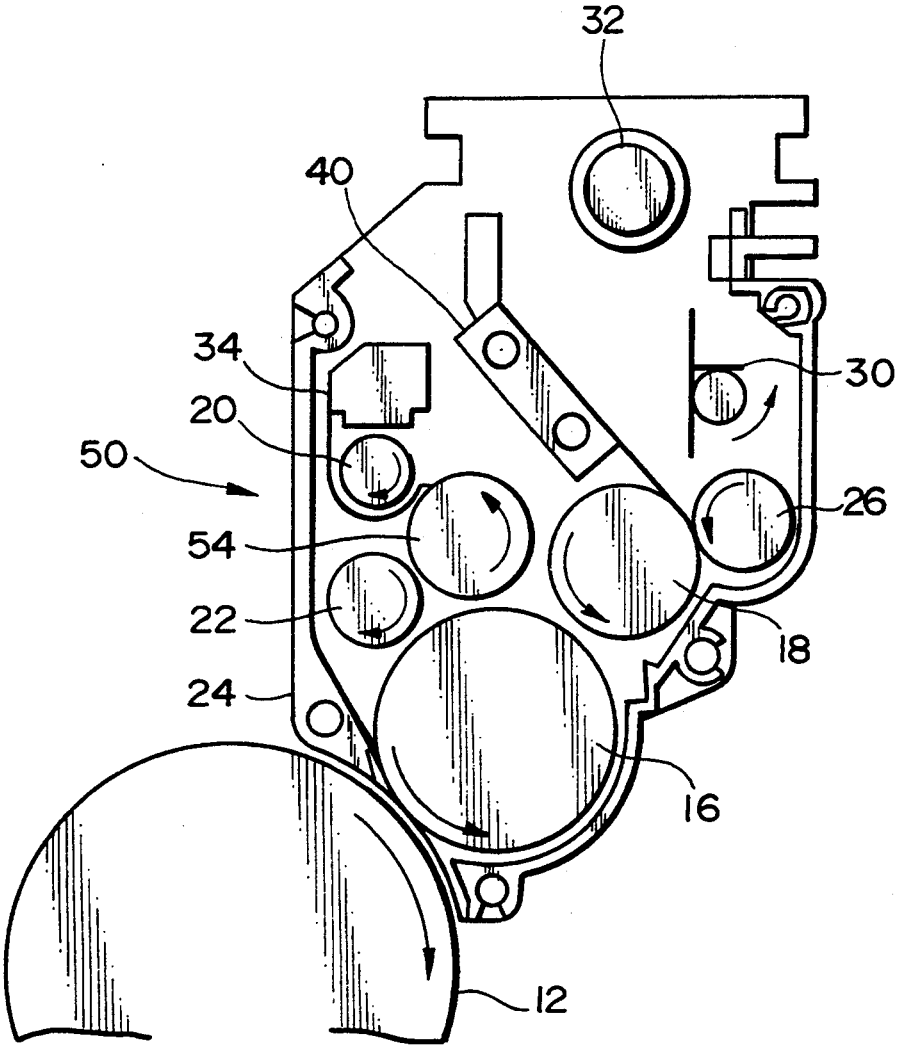
FIG. 14 is a section showing a modified embodiment of the present invention.

The illustrative embodiment includes two transport rollers, i.e., upper and lower transport rollers 52 and 54. Alternatively, the upper transport roller 52 may be omitted, as shown in FIG. 14. In the configuration shown in FIG. 14, one side edge of the screw casing 34 is shaped such that it not only receives the developer dropped from the lower roller 54 due to gravity, but also positively scrapes off the developer from the roller 54.

Figure 15:
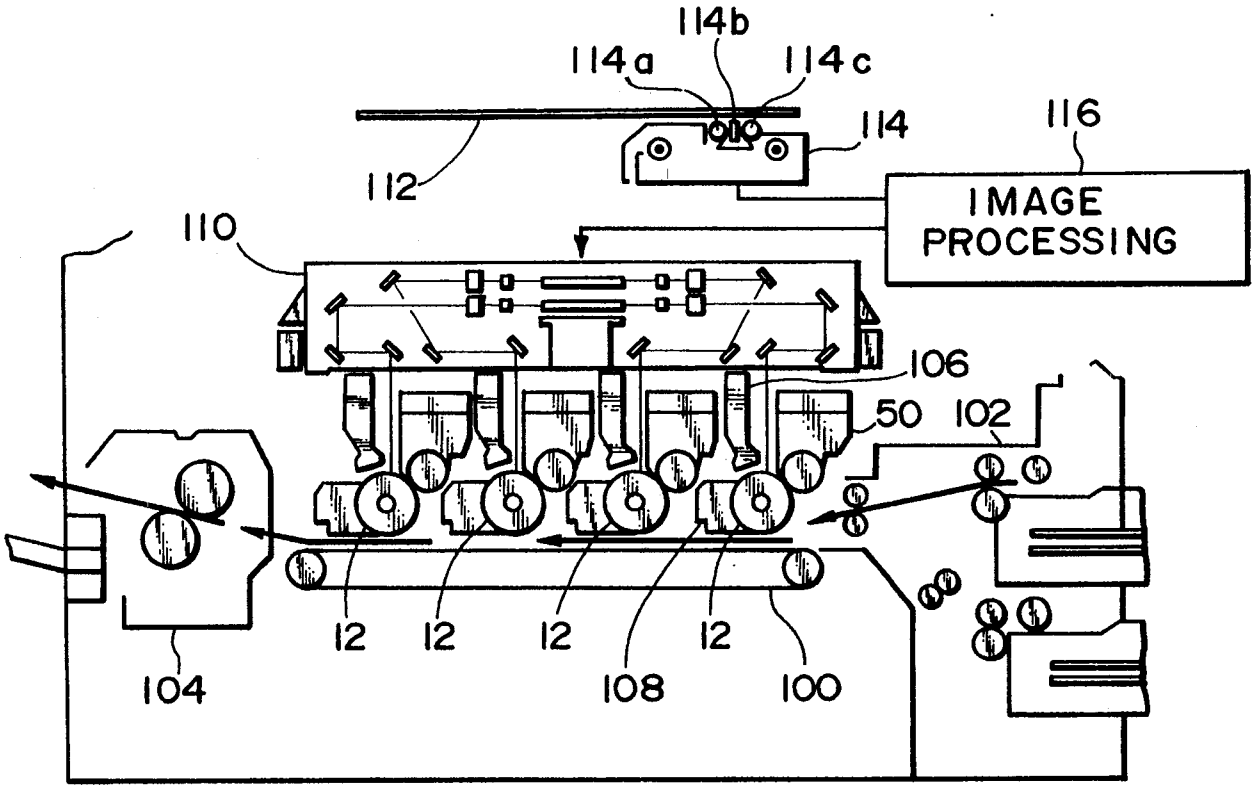
FIG. 15 is a section showing a color copier to which the present invention is applicable.

FIG. 15 shows a color copier implemented by the developing device 50 described above. As shown, the copier has four photoconductive drums 12 arranged side by side in the horizontal direction, and a transport belt 100 disposed below the drums 12. As a sheet is fed from a sheet feed section 102, toner images respectively formed on the drums 12 are sequentially transferred to the sheet to complete a color image. After the image on the sheet has been fixed by a fixing unit 104, the sheet is driven out of the copier as a color copy. To reduce the horizontal direction of the copier despite the horizontal arrangement of the drums 12. The horizontal dimension of each developing device 50 should be reduced as far as possible. This can be done with the embodiment in which a developer agitating section is disposed above the developing sleeve 16. In FIG. 15, a charger 106, a cleaning device 108 and so forth are arranged around each drum 12, while an optical writing unit 110 and a glass platen 112 are located above the drums 12. A reading unit 114 is movable below the glass platen 112 and includes a lamp **114*a*, a lens 114*b*, and a contact type CCD (Charge Coupled Device) array 114*c*. The output signal of the reading unit 114 is processed by an image processing section 116. The processed signal is used to drive the optical writing unit 110**.

While the present invention has been shown and described in relation to a developing device for an electrophotographic copier, it is, of course, applicable even to a cleaning device.

In summary, in accordance with the present invention, a fresh toner and a developer are sufficiently agitated and mixed together. This is successful in eliminating a change in image density among individual copies, irregularity in density corresponding to the spiral pitch of, for example, a toner transport screw, and irregularity in density in the front-and-rear direction (axial direction of a developing sleeve) ascribable to defective agitation. To replace or clean a desire part or parts built in a developing device, the present invention allows the device to be divided into two such that the desired parts are freely accessible. This facilitates the cleaning and replacement of such parts.

Various modifications will become possible for those skilled in the art after receiving the teachings of the present disclosure without departing from the scope thereof.

What is claimed is:

1. A developing device for supplying a developer made up of a toner and a carrier to an image carrier for thereby developing a latent image electrostatically formed on said image carrier, said device comprising:

a developer carrier for supplying the developer deposited thereon to said image carrier;

a toner supplying means for supplying toner to the developer deposited on said developer carrier in contact with said developer, said toner defined by a formation of toner on the developer carrier which has not been exposed to the image carrier;

a transporting means for scooping up an excess of the developer from said developer carrier over an entire longitudinal length of the developer carrier before the toner is exposed to the image carrier and transporting said excess developer in a predetermined direction; and an agitating means for agitating the developer scooped up and transported upward by said transporting means.

2. A device as claimed in claim 1, wherein said developer carrier comprises a rotatable developing sleeve accommodating a magnet therein.

3. A device as claimed in claim 2, wherein said transporting means comprises a first toner transporting means comprising:

a first rotatable scooping sleeve at a position just above an axis of said developing sleeve and downstream of the axis of the developing sleeve with respect to a direction in which the sleeve conveys the developer from the toner supplying means; and a first magnetic force generating means located at a predetermined position within said first scooping sleeve.

4. A device as claimed in claim 3, wherein said first magnetic force generating means is positioned such that a magnetic force on a surface of said first scooping sleeve decreases in the vicinity of said position just above the axis of said developing sleeve.

5. A device as claimed in claim 3, wherein said developing sleeve is rotated in the same direction and at the same linear velocity as said first scooping sleeve.

6. A device as claimed in claim 3, wherein said transporting means further comprises a second toner transporting means comprising:

a rotatable second scooping sleeve disposed above said first scooping sleeve; and a second magnetic force generating means located at a predetermined position within said second scooping sleeve.

7. A device as claimed in claim 6, wherein said first and second scooping sleeves are rotated in the same direction and at the same linear velocity as each other.

8. A device as claimed in claim 6, wherein said first and second magnetic force generating means are configured such that polarities thereof for transferring said developer from said first scooping sleeve to said second scooping sleeve are opposite in polarity to each other.

9. A device as claimed in claim 8, wherein said first and second magnetic force generating means are configured such that angular directions of peak points of said polarities intersect each other at an angle ranging from 30 degrees to 70 degrees at a smaller angle side.

10. A device as claimed in claim 9, wherein each of said first and second magnetic force generating means comprises a single block magnet.

11. A device as claimed in claim 10, wherein said block magnet is configured such that angular directions of peak points of an N and an S pole intersect each other at an angle ranging from 45 degrees to 90 degrees.

12. A device as claimed in claim 10, wherein said block magnet exerts a greater magnetic force at an upstream pole than at a downstream pole with respect to an intended direction of developer transport.

13. A device as claimed in claim 10, wherein said block magnet is configured such that a pole adjoining said developing sleeve has a greater dimension in a longitudinal direction than a pole exerting a magnetic force on a surface of said developing sleeve adjoining said scooping sleeve.

14. A device as claimed in claim 10, wherein said agitating means comprises a screw means for agitating said developer scooped up in an axial direction of said developing sleeve.

15. A device as claimed in claim 14, wherein said block magnet is configured such that a range where a magnetic force is zero gauss extends over an angle ranging from 90 degrees to 200 degrees on a side where said screw means is located.

16. A device as claimed in claim 6, wherein said first magnetic force generating means is configured such that an angular direction of a peak point of a pole adjoining said developing sleeve and an angular direction of a peak point of a pole exerting a magnetic force on a surface of said developing sleeve adjoining said first scooping sleeve intersect each other at an angle ranging from 80 degrees to 100 degrees.

17. A device as claimed in claim 6, wherein said agitating means comprises:

a first screw for agitating the developer transferred from said second toner transporting means, while transporting said developer in a predetermined direction along the axis of said developing sleeve; and a second screw for agitating the developer transferred from said first screw, while transporting said developer in a direction opposite to said predetermined direction.

18. A device as claimed in claim 17, wherein said agitating means further comprises a screw casing surrounding at least a lower portion of said first screw.

19. A device as claimed in claim 18, wherein said screw casing comprises:

at least one opening adjoining one end of said screw casing; and at least one overflow opening formed through a side wall portion opposite to a side wall portion facing said first and second toner transporting means.

20. A device as claimed in claim 17, wherein said first screw has a spiral pitch smaller than a spiral pitch of said second screw.

21. A device as claimed in claim 17, wherein said first screw has a spiral diameter smaller than a spiral diameter of said second screw.

22. A device as claimed in claim 17, wherein said first screw is rotated at a lower speed than said second screw.

23. A device as claimed in claim 1, further comprising:

a developer supply unit accommodating said toner supplying means;

a developer agitating unit accommodating said developer transporting means and said agitating means; and two side wall pairs physically independent of each other, respectively associated with said developer supply unit and said developer agitating unit, and separable from each other to separate said developer supply unit and said developer agitating unit.

24. A process unit for image formation, comprising:

a rotatable body needing cleaning or replacement; and a first and a second physically independent side wall pair overlapping each other at opposite sides with respect to an axial direction of said rotatable body, said first and second side wall pairs each being provided with a hole for a bearing at each of opposite overlapping portions;

said rotatable body including opposite shaft portions held by said first side wall pair via first bearings which are removably mounted on said shaft portions and received in said holes of said first side wall pair, said shaft portions being further held by said second side wall pair via second bearings which are removably mounted on said shaft portions and received in said holes of said second side wall pair.

25. A unit as claimed in claim 24, wherein said first and second bearings associated with each other are formed integrally with each other.

26. A unit as claimed in claim 25, further comprising bearing housings respectively received in said holes of one of said first and second side wall pairs which is located more inwardly in said unit than the other side wall pair, said bearing housings each being provided with an end covering substantially an entire inner end of associated one of said bearings.

27. A unit as claimed in claim 24, wherein said unit constitutes a developing device.

28. A unit as claimed in claim 24, wherein said process unit constitutes a cleaning unit.

29. A process unit for image formation, comprising:

a rotatable body needing cleaning or replacement;

a contact member contacting periphery of said rotatable body in an axial direction of said rotatable body, said rotatable body, said contact member and a side wall forming a part of walls which define a developer storing section;

a first side wall pair constituting opposite side walls of said developer storing section; and a second side wall pair constituting opposite side walls of said unit other than said developer storing section, said first and second side wall pairs being divided at a position close to opposite sides of said rotatable body with respect to an axial direction of said rotatable body;

said rotatable body and said contact member being held by said first side wall pair.

30. A unit as claimed in claim 29, wherein said rotatable body includes opposite shaft portions held at least by said first side wall pair via bearings which are removably mounted on said shaft portions and received in holes formed in said first side wall pair.

31. A unit as claimed in claim 30, further comprising a restricting means for restricting a position of each of said shaft portions such that when said bearings are removed, a displacement of said shaft portion in a direction perpendicular to an axis of said shaft portion does not exceed in a range which maintains said contact member in contact with said rotatable body.

32. A process unit for image formation, comprising:

a flat member needing cleaning or replacement and constituting a part of walls of a developer storing section in combination with a side wall;

a first side wall pair constituting opposite side walls of said developer storing section; and a second side wall pair constituting opposite side walls of said unit other than said developer storing section;

said flat member being removably held by said first side wall pair.

33. A unit as claimed in claim 32, wherein said unit constitutes a developing device.

* * * * *